US010433591B2

(12) United States Patent
Gilde

(10) Patent No.: US 10,433,591 B2
(45) Date of Patent: Oct. 8, 2019

(54) PRESSED COLLAR PROTECTOR

(71) Applicant: Thin Air Ventures, LLC, McBain, MI (US)

(72) Inventor: Adam D. Gilde, McBain, MI (US)

(73) Assignee: Thin Air Ventures, LLC, McBain, MI (US)

( * ) Notice: Subject to any disclaimer, the term of this patent is extended or adjusted under 35 U.S.C. 154(b) by 0 days.

(21) Appl. No.: 15/809,457

(22) Filed: Nov. 10, 2017

(65) Prior Publication Data

US 2018/0263297 A1 Sep. 20, 2018

Related U.S. Application Data

(60) Provisional application No. 62/473,702, filed on Mar. 20, 2017.

(51) Int. Cl.
*A41B 3/18* (2006.01)

(52) U.S. Cl.
CPC ..... *A41B 3/18* (2013.01)

(58) Field of Classification Search
CPC .. A41B 3/18; A41B 3/06; A41D 27/16; B65D 85/18; B65D 85/182
See application file for complete search history.

(56) References Cited

U.S. PATENT DOCUMENTS 646,748 A * 4/1900 Schlesinger ..... A41D 27/16 2/60
808,816 A * 1/1906 Memminger ..... A41D 27/16 2/60
879,955 A * 2/1908 Frank ..... A41D 27/16 2/60
1,231,206 A * 6/1917 Schenck ..... A41D 27/16 2/60
1,267,394 A * 5/1918 Ferguson ..... A41D 27/16 2/60
1,478,583 A * 12/1923 Schlesinger ..... A41D 27/16 2/60
2,053,564 A 9/1936 Knopp
2,275,098 A 3/1942 Welch
2,518,300 A 8/1950 Fine, Sr.
2,633,576 A * 4/1953 Powers ..... A41D 27/16 2/129

(Continued)

FOREIGN PATENT DOCUMENTS

FR 1088274 A * 3/1955 ..... A41D 27/16
WO WO 2010052491 A2 * 5/2010 ..... A41B 3/18
WO WO 2013132474 A1 * 9/2013 ..... A41B 3/18

*Primary Examiner* — Clinton T Ostrup
*Assistant Examiner* — Andrew Wayne Sutton
(74) *Attorney, Agent, or Firm* — Northern Michigan Patent Law, PLC

(57) ABSTRACT

A shirt collar protector comprising and inner support band configured to fit underneath a collar around the outside of the collar band, and a separable outer clamping band having inner and outer clamping faces configured to clamp against the outer face of the collar and the inner face of the collar band, with the inner support band and the collar clamped and protected therebetween. A plurality of spring clips are spaced along the lower edge of either the inner support band or the outer clamping band, the clips having ends configured to fit underneath the lower edges of the collar to clamp them together.

7 Claims, 9 Drawing Sheets

(56) References Cited

U.S. PATENT DOCUMENTS

| | | | | |
|---|---|---|---|---|
| 4,008,494 | A * | 2/1977 | Hicks | A41D 27/16 2/60 |
| 4,133,463 | A | 1/1979 | Bourrian | |
| 4,953,232 | A * | 9/1990 | Gaines | A41B 3/18 2/131 |
| 5,769,287 | A | 6/1998 | Kim | |
| 6,889,387 | B1 | 5/2005 | Tiss et al. | |
| 2013/0269078 | A1 | 10/2013 | Andrade et al. | |
| 2015/0284893 | A1* | 10/2015 | Mota | D06C 15/10 223/52.1 |
| 2016/0135508 | A1* | 5/2016 | Lawrence | A41B 3/18 2/129 |

* cited by examiner

PRESSED COLLAR PROTECTOR

RELATED APPLICATIONS/PRIORITY BENEFIT CLAIM

This application claims the benefit of U.S. Provisional Application No. 62/473,702, filed Mar. 20, 2017 by the same inventor (Gilde), the entirety of which provisional application is hereby incorporated by reference.

FIELD

The subject matter of the present application is in the field of shirt collar protectors, specifically for maintaining the shape of a shirt collar in storage.

BACKGROUND

Devices for maintaining the shapes of shirt collars in storage are known. A typical approach seems to be to slide a partial or full supporting band or similar member underneath the collar, and to optionally lock it in place with a tab engaging the collar points at the throat, sometimes in conjunction with stays. Examples are shown in U.S. Pub No. 2013/0269078; U.S. Pat. Nos. 5,769,287; 4,133,463; 6,889,387 (Tiss et al.), U.S. Pat. No. 2,518,300 (Fine, Sr.); and U.S. Pat. No. 2,275,098 (Welch).

U.S. Pat. No. 2,053,564 to Knopp teaches a shirt collar protector with an inner band located against the inside face of the collar band, and a rear flap that folds over and underneath the rear of the collar to hold the inner band in place. The front ends of the inner band can be secured together at a notch in one end.

It is believed that the prior art does not teach a protector that is convenient to apply and that both protects and supports the entirety of the collar in storage, even when the shirt is stored with items pressing on top of it, for example when packed in a suitcase.

BRIEF SUMMARY

The present invention is a shirt collar protector for preserving both the shape and the smooth finish of a stand-up type collar during storage. The collar protector comprises an inner support band configured to fit around the outside face of a collar's band or "stand", underneath the collar itself; and an outer clamping band of substantially equal length.

The outer clamping band is longitudinally folded or formed into inner and outer clamping faces of a circumferential length substantially equal to that of the inner support band. The outer clamping face is sufficiently wide to lay flat and press against substantially the entire outer face of the collar. The inner and outer clamping faces may have a spring tension biasing them toward one another to clamp a collar between them.

In a first embodiment, the outer clamping face has a plurality of clips spaced along its lower edge, the clips having free or hook ends configured to hook underneath both the collar edge and the lower edge of the inner support band to better secure the collar between the inner support band and the outer clamping band.

The clips have a spring tension when engaged with the inner support band to firmly clamp the collar between the inner support band and outer clamping band. The clip spring tension may be supplemented by spring tension between the inner and outer clamping faces provided by the longitudinal hinge or bend in the outer clamping band. The clips may be integrally formed or permanently connected to the outer clamping face, or they may be removably attached.

In a second embodiment, the clips are formed on the inner support band, extending outwardly from a lower end of the inner support band to wrap around the bottom edge of the collar and partway up the outer face of the outer clamping band. In a further form, the outer clamping band has external clip-engaging detents formed on its outer face, located to positively engage the ends of the clips.

In a further form, the inner clamping face of the outer clamping band has an inwardly-angled lower lip extending circumferentially around the band in order to guide the upper edges of the inner support band and collar between the outer band's clamping faces.

These and other features and advantages of the invention will become apparent from the detailed description below, in light of the accompanying drawings.

DETAILED DESCRIPTION

Figure 1:
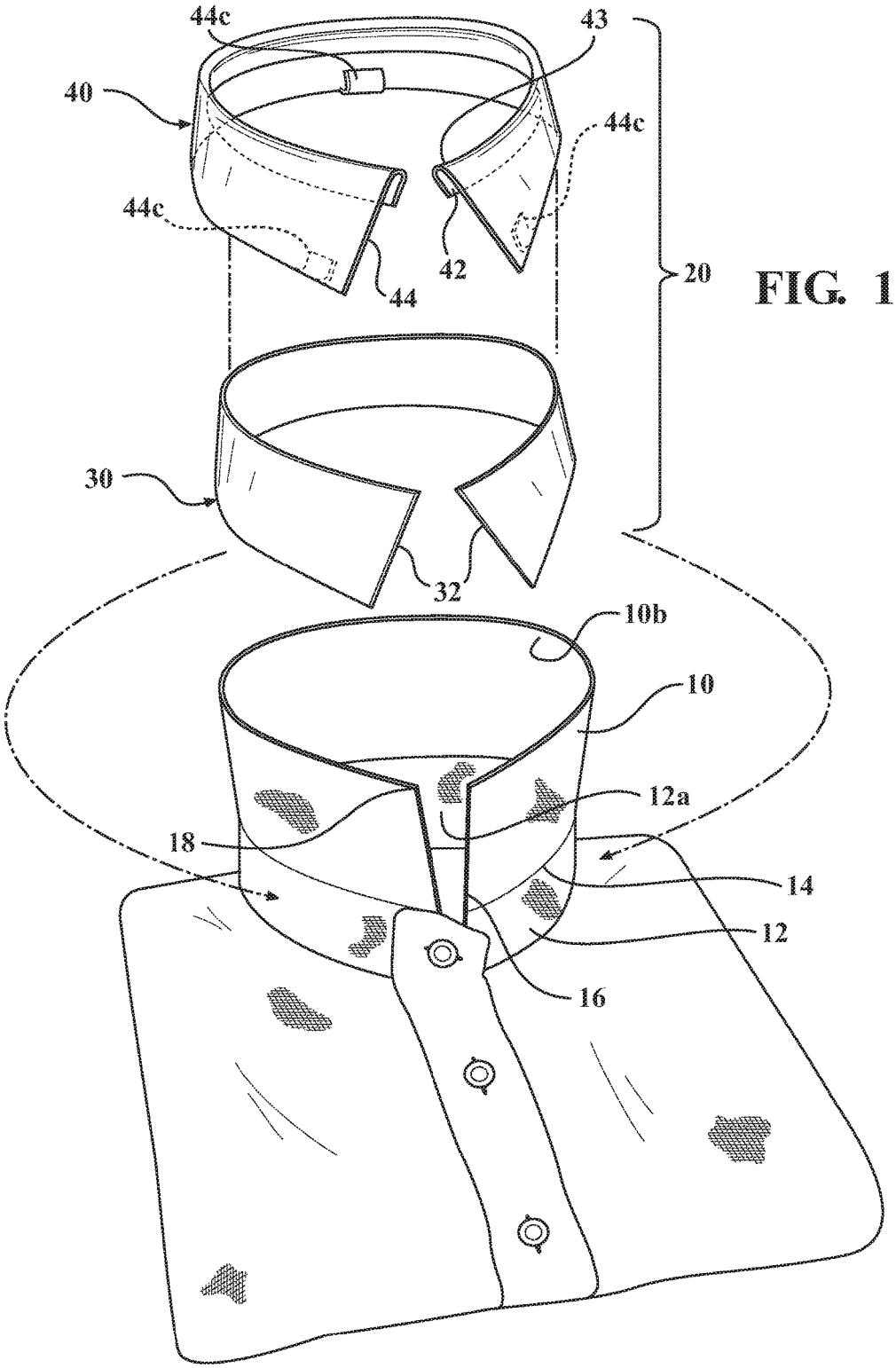
FIG. 1 is a front perspective view of a shirt collar with an example protector according to the invention, the protector exploded relative to the collar prior to being applied.
Figure 2:
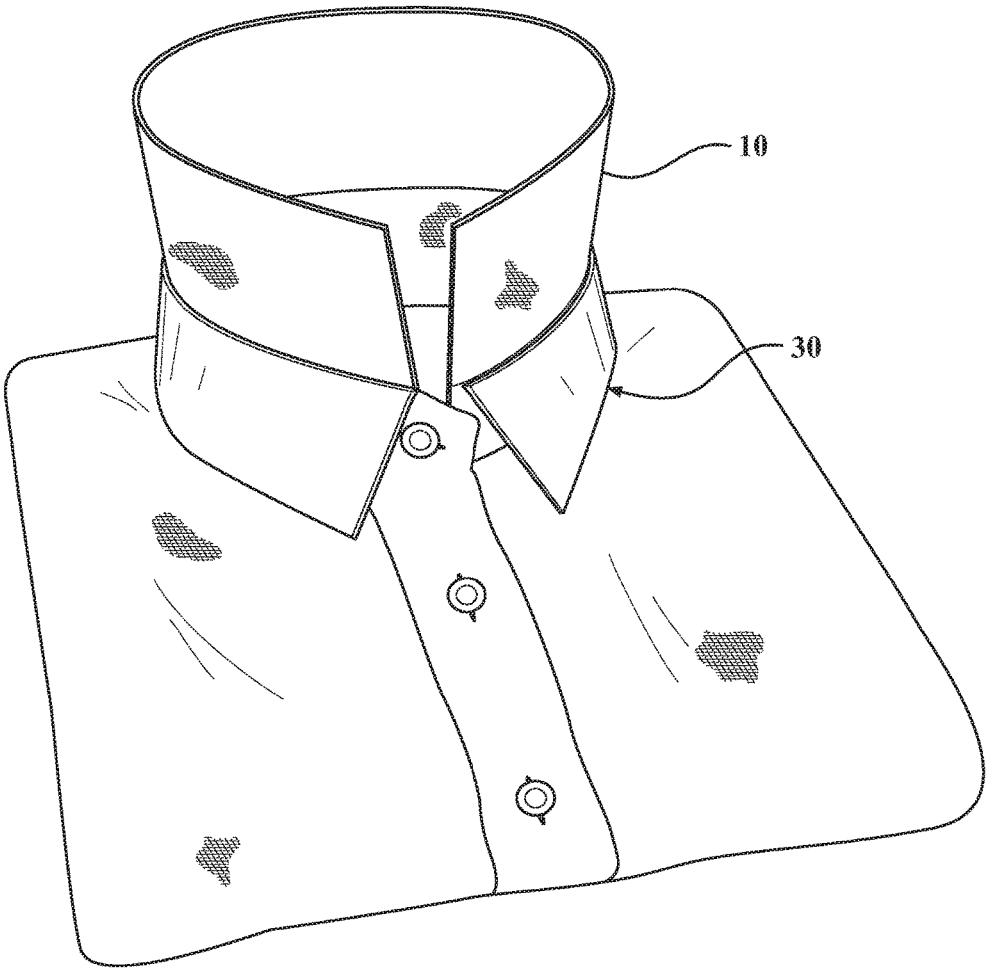
FIG. 2 is similar to FIG. 1, but shows the protector partially applied to the collar.
Figure 3:
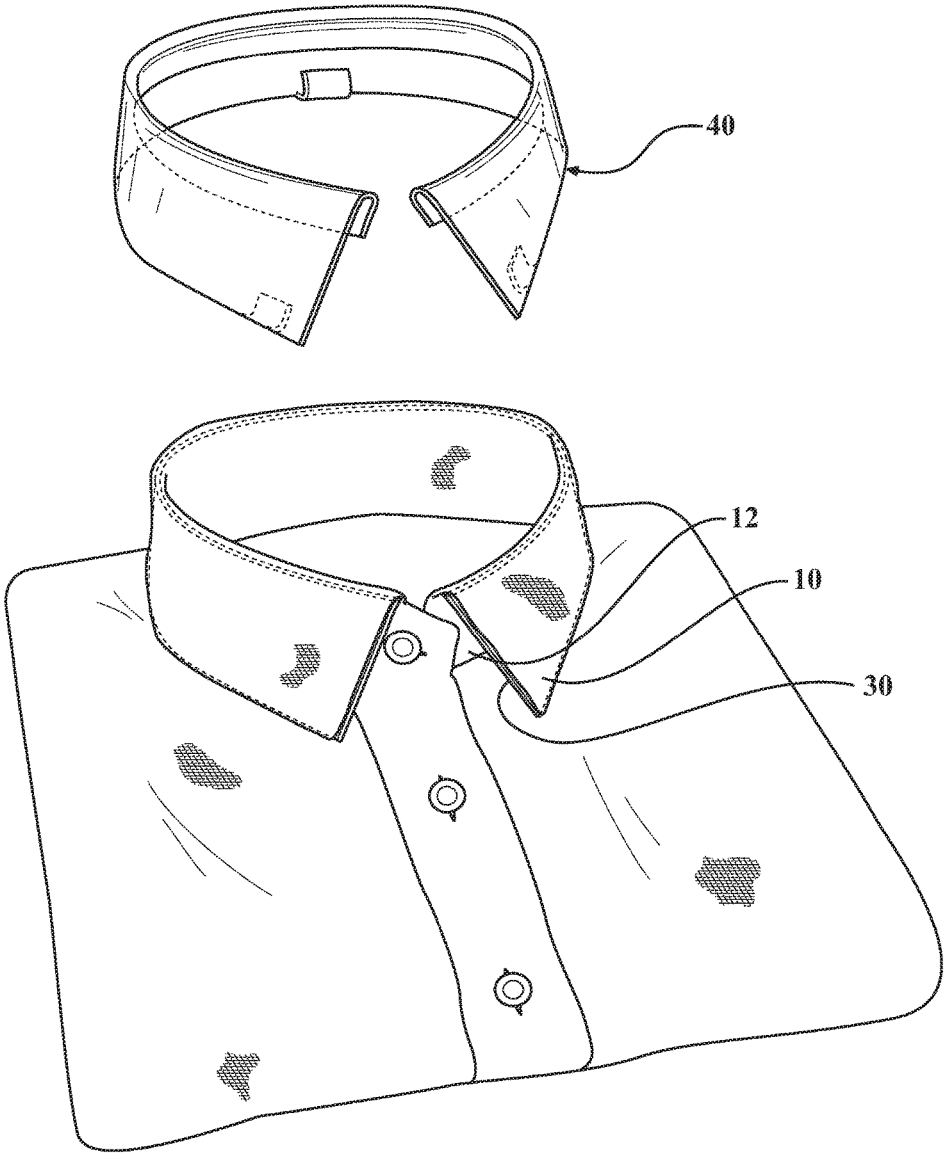
FIG. 3 is similar to FIG. 2, but shows the protector more fully applied to the collar.
Figure 4:
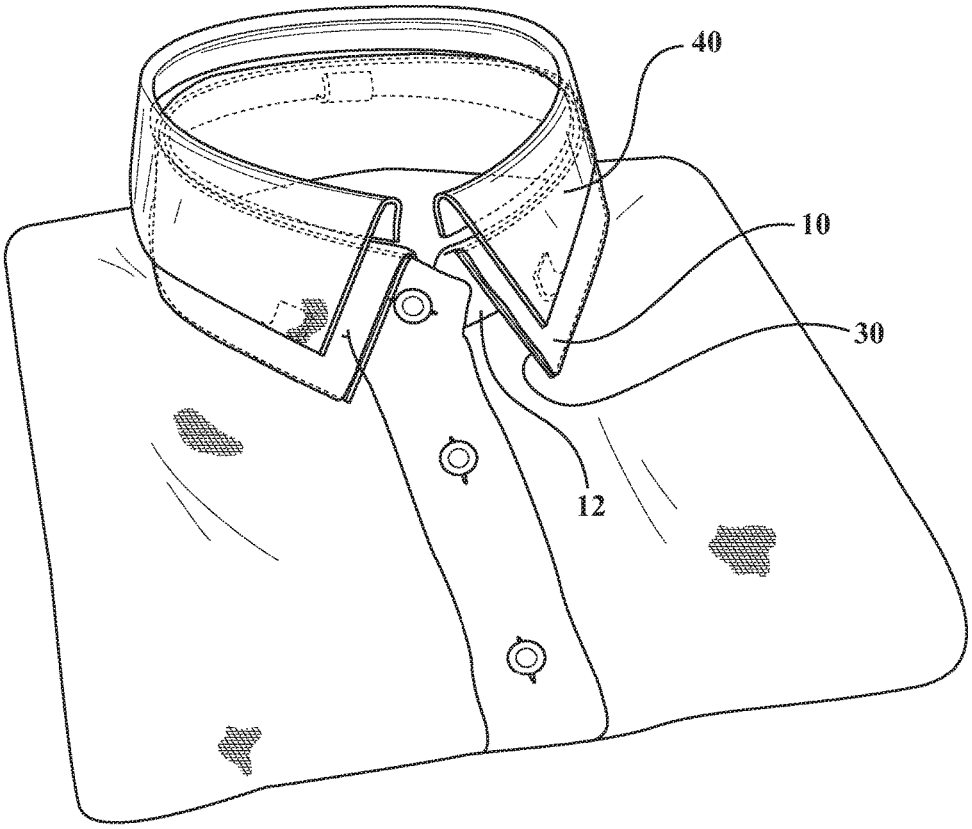
FIG. 4 is similar to FIG. 3, but shows the protector almost fully applied to the collar.

Referring first to FIG. 1, shirt collar 10 and a collar protector 20 are shown in exemplary form in order to teach how to make and use the claimed invention.

Collar 10 will generally be made from a smooth-finished, somewhat structured fabric of the type used in "dress" shirts and meant to be pressed for a neat appearance, although protector 20 may be used with softer, less structured collars. Collar 10 is spaced from the shirt's neck opening in known manner by a collar band or stand 12, typically with a fold or seam 14 separating the collar 10 from the band 12. Collar 10 terminates at the front or throat portion 16 of band 12 with points 18.

Collar protector 20 is shown in FIG. 1 separated into its two main components: inner support band 30 and outer clamping band 40. Both bands 30, 40 are made from thin sheets of flexible material capable of taking a set shape and resisting deformation from vertical pressure against the upper edge thereof when formed into roughly circular shapes corresponding to the shape of collar 10 and band 12. For example, lightweight, flexible, but strong plastics such as nylon or polyethylene could be used, with thicknesses measured in the range of millimeters or fractions thereof, molded or otherwise set into matching curved configurations as shown.

Inner support band 30 has a length, shape and area corresponding to the shape and area of collar 10. Inner support band 30 may be angled or contoured as shown with trapezoidal ends 32 and curved edges, or with other edge configurations, to more closely match the shape of a particular style of collar.

Outer clamping band 40 is divided lengthwise into inner and outer clamping faces 42 and 44 by a longitudinal fold, bend or hinge portion 43 (hereafter "hinge"). Hinge 43 may be formed in the plastic or other material of band 40 in known manner, for example with a line of reduced thickness, a connecting strip of material more flexible than the main band portions, partial perforations, a molded shape, or a living-hinge of material formed when the band is molded. The inner and outer clamping faces 42, 44 may spread or fold freely about hinge portion 43; or they may be molded into a substantially fixed folded shape with some natural but limited flex toward and away from one another; or they may be biased toward one another with a spring tension, as shown in the illustrated example, even to the point of touching when at rest.

Figure 5:
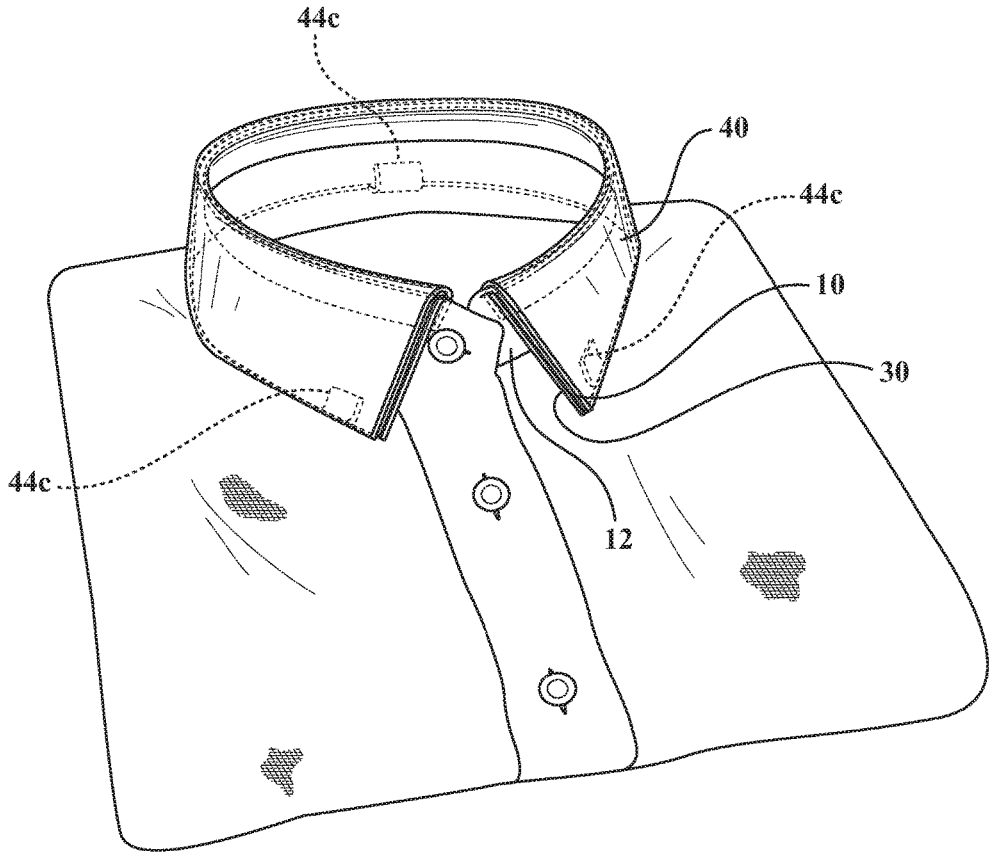
FIG. 5 is similar to FIG. 4, but shows the protector fully applied to the collar.

Inner clamping face 42 has a length, shape and area corresponding to the length and shape of collar band 12 inner face 12*a*, although its area may be reduced as shown in the illustrated example where clamping face 42 overlies only an upper circumferential portion of collar band inner face 12*a* when outer clamping band 40 is in place (best shown in FIG. 5), perhaps a third or a quarter of the area of inner face 12*a*. Outer clamping face 44 has a length, shape and area corresponding more closely to the outer face 10*b* of collar 10, so that outer clamping face 44 substantially overlies or covers the outer face 10*b* of collar 10.

Outer clamping face 44 is provided with a plurality of spaced clips 44*c*, preferably (but not limited to) three evenly spaced clips as shown. Clips 44*c* are configured to hook under and clamp corresponding portions of collar 10 and inner support band 30 against outer clamping face 44 when applied as described below.

In the illustrated example, clips 44*c* are integrally formed or molded with outer clamping face 44. The clips may also be separately formed and either removably or permanently attached, for example where it is desired to use a different material such as a thin springy sheet metal or a different plastic.

Figure 7:
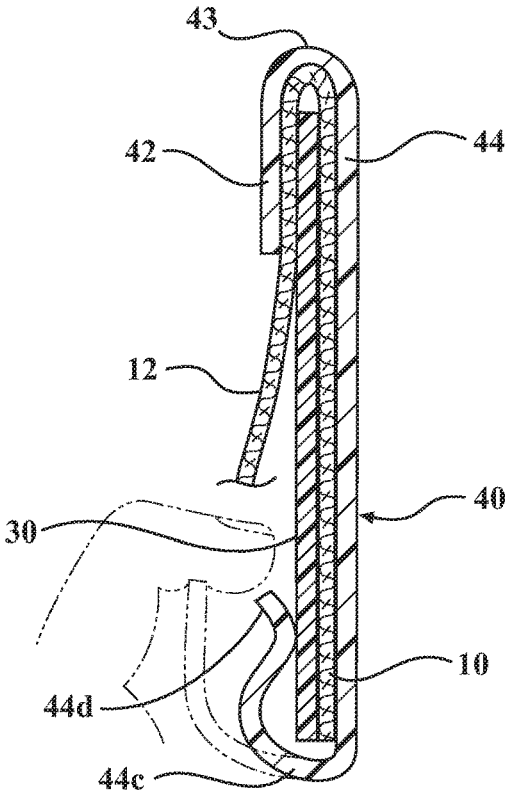
FIG. 7 is a side section view of the assembled protector and collar of FIG. 1 through a clip section.

Clips 44*c* in the illustrated example are curved or bent such that their free ends are biased toward the inner face 44*a* of outer clamping face 44 under spring tension. As shown in FIG. 7, the free ends of clips 44*c* may also include a right-angled outward-directed shoulder 44*d* to make it easier to pry the clips 44*c* away from outer face 44 using a finger.

Figure 6:
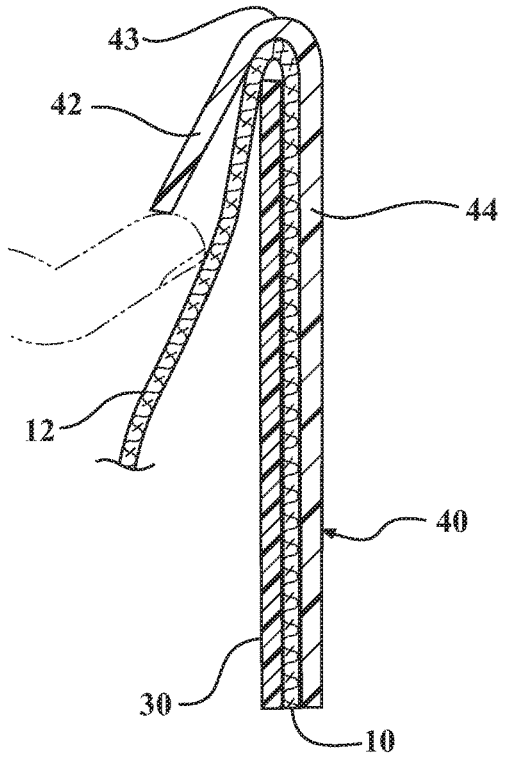
FIG. 6 is a side section view of the assembled protector and collar of FIG. 1 through an intermediate section.

As best shown in FIGS. 6 and 7, inner support band 30 has a height corresponding to outer clamping face 44 of clamping band 40, such that support band 30 fits closely between hinge 43 and clips 44*c* when the inner and outer bands 30, 40 are assembled.

Figure 8:
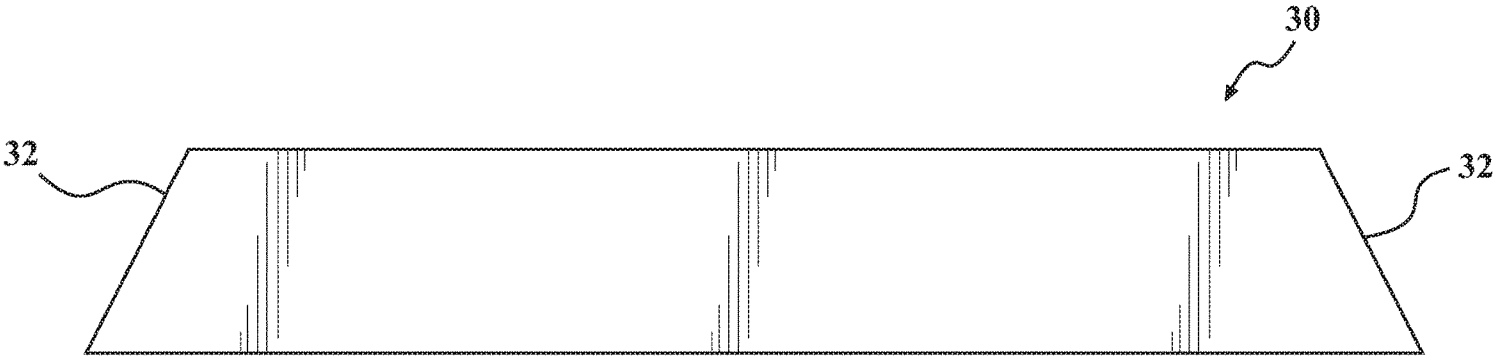
FIG. 8 is a plan view of the inner support band portion of the protector in a flat condition.
Figure 9:
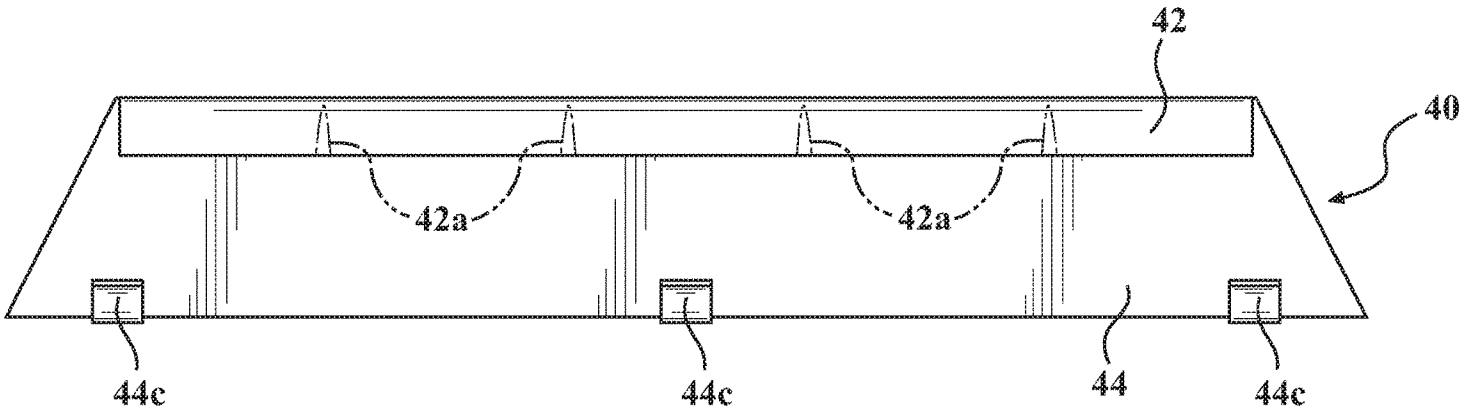
FIG. 9 is a plan view of the outer clamping band portion of the protector in a flat condition.

FIGS. 8 and 9 schematically show inner support band 30 and outer clamping band 40 as they would appear if flat, for example prior to being molded or shaped into the self-sustaining curved collar configurations in the preceding Figures. FIG. 9 also shows optional relief cuts 42*a* formed in inner clamping face 42, effectively dividing face 42 into sections that can be sequentially pried away from outer clamping face 44 to fit over the collar when the outer clamping band 40 is being applied.

Figure 10:
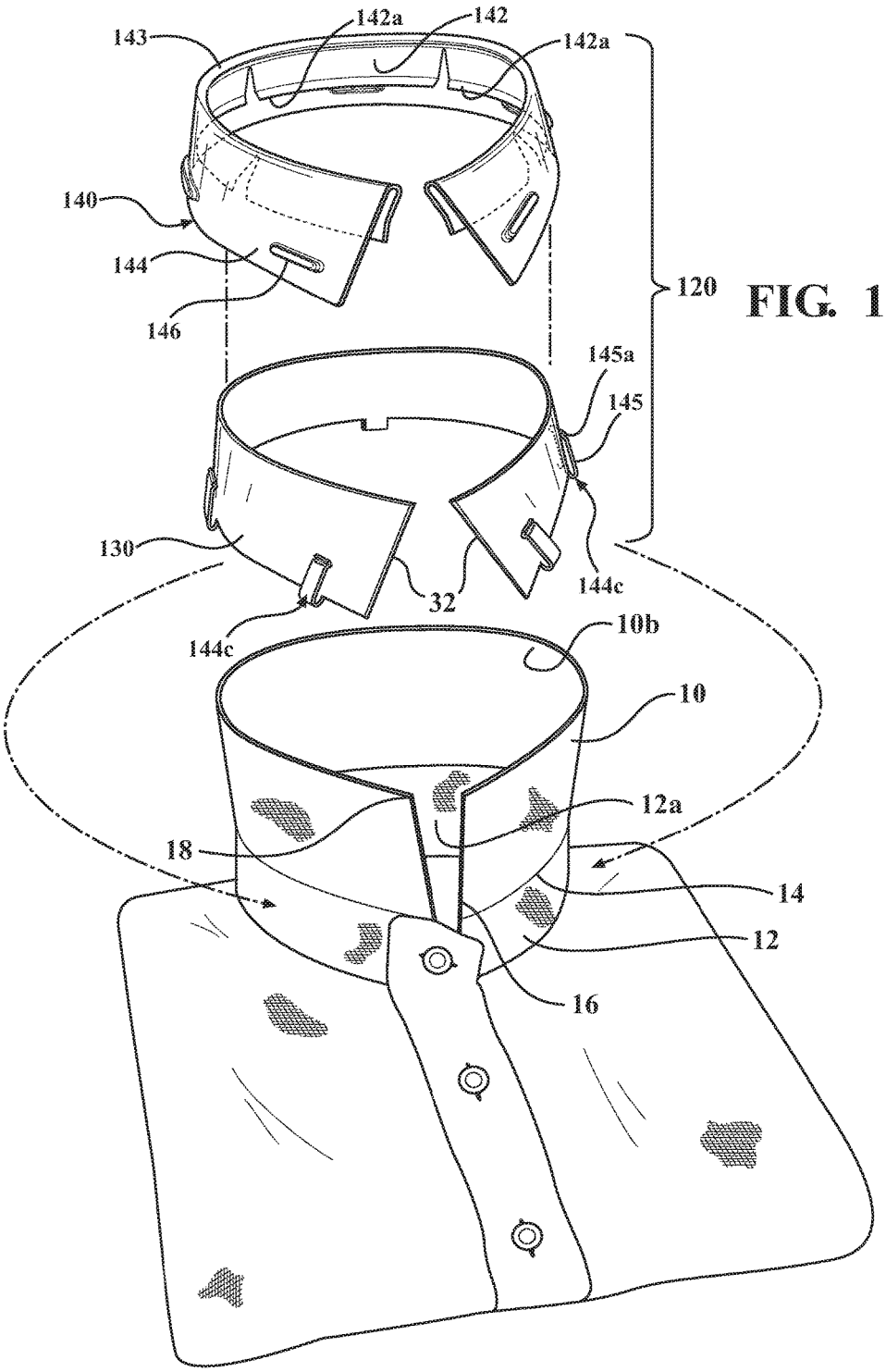
FIG. 10 is similar to FIG. 1, but shows a second embodiment of the invention in which clips are formed on the inner support band.
Figure 11:
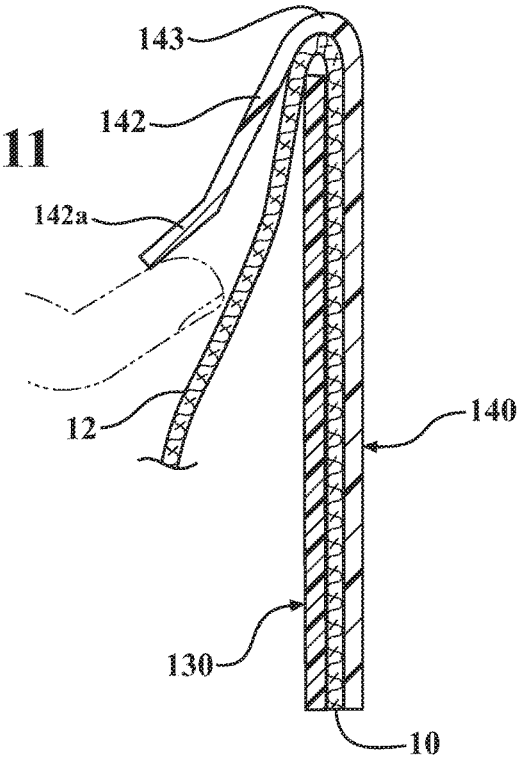
FIG. 11 is a side section view of the assembled protector and collar of FIG. 10 through an intermediate section.
Figure 12:
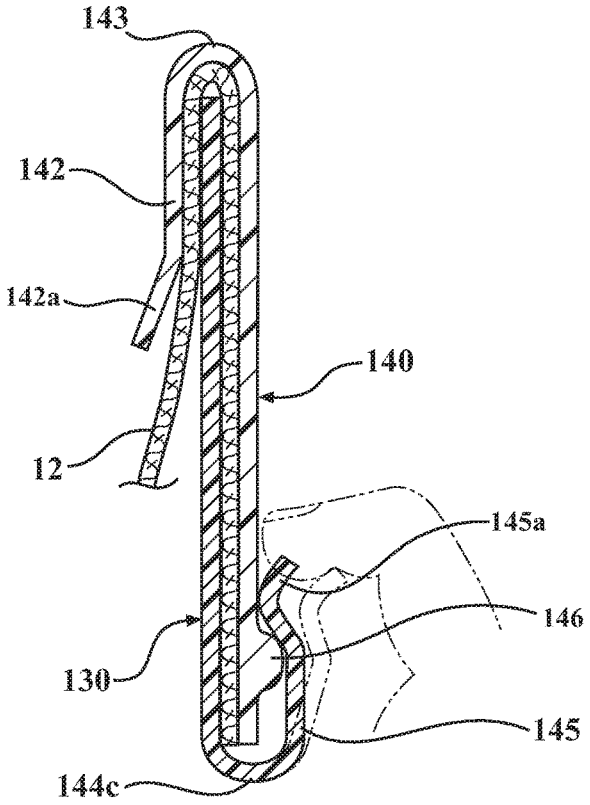
FIG. 12 is a side section view of the assembled protector and collar of FIG. 10 through a clip section.

FIGS. 10-12 shows an alternate embodiment of the collar protector at 120, comprising an inner support band 130 and an outer clamping band 140 similar to those above in FIGS. 1-9 but having clips 144*c* formed along and extending from the lower edge of the inner clamping band, facing outwardly. Clips 144*c* may be the same as shown in FIGS. 1-9, but in the example of FIGS. 10-12 they have a flattened main body 145 with a more angularly indented, stepped free end or "hook" 145*a* configured to mate with surface features 146 formed on the outer clamping face 144 of outer clamping band 140.

Surface features 146 may take different forms, in the illustrated example having the form of elongated beads or detents protruding from outer clamping face 144. Detents 146 are shaped and positioned so that free ends 145*a* of clips 144*c* ride over and snap into place on their upper surfaces under spring tension.

Surface features 146 may also be indents or apertures formed in the outer clamping face, shaped to receive the free ends 145*a* of clips 144*c* in a tensioned, releasably locking fit.

Still referring to FIGS. 10-12, the inner clamping face 142 of outer clamping band 140 is provided with an inwardly-angled flange or lip 142*a* extending around its lower edge. Angled lip 142*a* extends inwardly toward the interior of collar 10 (best seen in FIGS. 11 and 12) at an angle to provide a feed ramp effect with respect to the mated upper edges of collar 10 and inner support band 130, and which provides purchase for a finger if desired to flex the inner and outer clamping faces apart when inserting the collar and inner support band. When inner support band 130 is in place under collar 10 against the outer side of collar band 12, and outer collar portion 10*b* folded down over the outside of support band 130, the outer clamping band 140 is pushed down over them. Angled lip 142*a* helps feed the joined upper edges of the inner support band 130 and collar 10 smoothly into the space between the inner and outer clamping faces 142, 144 of outer clamping band 140.

Description of Operation

In operation, protector 20 as shown in FIGS. 1-9 is used by first placing inner support band 30 underneath collar 10, around the outer face 12*b* of collar band 12, for example by flexing it apart slightly as shown by the dotted lines in FIG. 1, placing it around the collar band, and then letting it return to its pre-set form around the collar band. Next, outer clamping band 40 is placed over collar 10, with outer clamping face 44 overlying the outer face 10*b* of the collar, and with inner clamping face 42 overlying the inner face 12*a* of collar 12 inside the collar. Depending on the spring tension or bias of inner and outer clamping faces 42, 44 toward one another, they may need to be slightly spread or pried apart with a finger to fit clamping band 40 over the collar and the support band 30 underneath the collar.

Finally, the free ends 44*d* of clips 44*c* spaced along the lower edge of outer clamping face 44 are inserted up underneath the lower edges of collar 10 and of inner support band 30. Depending on the spring tension of clips 44*c*, ends 44*c* may need to be momentarily pried open to fit the lower edges of collar 10 and inner support band 30 into the clips.

Operation of protector 120 as shown in FIGS. 10-12 is substantially the same as for protector 20 in FIGS. 1-9, except that the edge 10*b* of the shirt collar 10 is inserted into clips 144*c* after the inner support band 130 is placed around the collar band and the collar is folded down over the support band, and clips 144*c* are pried apart from the outside of the collar protector assembly as the outer clamping band is mated with the inner support band over the collar, if needed. Clips 144*c* serve two purposes in the example of FIGS. 10-12: they help hold the shirt collar 10 in place while outer clamping band 140 is slid over inner support band 130, and they apply pressure for maintaining collar shape between the mated inner and outer pieces 130, 140.

The collar 10 thus protected by protector 20 is both substantially covered on its outer face, and supported by a two-part, essentially full circumferential length structure comprising the inner support band 30 and outer clamping band 40. The clamping connection between bands 30 and 40 prevents shifting or lifting with respect to the collar, and is sufficiently strong to prevent the collar from being flattened or crumpled by the pressure of other clothing or objects stored or packed on tip of the shirt.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A shirt collar protector configured to be used with a shirt collar attached to a shirt with a collar band for preserving collar shape and finish during storage, the shirt collar protector comprising:

an inner support band comprising a flexible material and having a length, area and set curved shape corresponding to a shirt collar and configured to fit around an outside face of a collar band underneath a corresponding shirt collar;

an outer clamping band separate from the inner support band and comprising a flexible material divided lengthwise about a longitudinal hinge portion into spaced inner and outer clamping faces of a set curved shape and length corresponding to that of the inner support band and a corresponding shirt collar, the outer clamping face further having an area corresponding to that of the inner support band and a corresponding shirt collar, the outer clamping face configured to lie flat and press against the inner support band and a corresponding shirt collar therebetween; and, a plurality of spaced spring clips located along a lower edge of a first one of the inner support band and the outer clamping band, the spring clips each comprising an upwardly facing free end with a spring tension biasing the free end toward a surface of the first one of the inner support band and the outer clamping band for securing a lower edge of a second one of the outer clamping band and the inner support band and of a corresponding shirt collar therebetween.

2. The shirt collar protector of claim 1, wherein the spring clips are located along a lower edge of the outer clamping face of the outer clamping band, facing inwardly.

3. The shirt collar protector of claim 1, wherein the spring clips are located along a lower edge of the inner support band, facing outwardly.

4. The shirt collar protector of claim 3, wherein the outer clamping face of the outer clamping band is provided with clip receiving features configured to releasably lockingly engage the free ends of the spring clips when the outer clamping band is mated with the inner support band.

5. The shirt collar protector of claim 1, wherein a lower edge of the inner clamping face of the outer clamping band comprises an inwardly-angled lip extending circumferentially around the lower edge of the inner clamping face.

6. The shirt collar protector of claim 1, wherein the inner clamping face of the outer clamping band overlies only an upper circumferential portion of an inner face of a corresponding collar band.

7. A shirt collar protector for preserving the shape and finish of a corresponding shirt collar attached to a shirt with a collar band during storage, the shirt collar protector comprising:

an outer clamping band comprising a flexible material divided lengthwise about a longitudinal hinge portion into opposing spaced inner and outer clamping faces of a set curved shape and length and a spacing sufficient to receive at least upper edges of a collar band and shirt collar therebetween, the outer clamping face further having a height greater than a height of the inner clamping face to define a collar-covering area for a corresponding shirt collar;

a separate inner support band comprising a flexible material and having a length, area and set curved shape corresponding to the outer clamping face of the outer clamping band and configured to fit between the inner and outer clamping faces of the outer clamping band; and, a plurality of spaced spring clips located along a lower edge of a first one of the inner support band and the outer clamping band, the spring clips each comprising an upwardly facing free end with a spring tension biasing the free end toward a surface of the first one of the inner support band and the outer clamping band for securing a lower edge of a second one of the outer clamping band and the inner support band and of a corresponding shirt collar therebetween.

* * * * *